United States Patent [19]

Imamura

[11] 4,114,363

[45] Sep. 19, 1978

[54] ELECTRONIC TIMEPIECE

[75] Inventor: Yoichi Imamura, Suwa, Japan

[73] Assignee: Kabushiki Kaisha Suwa Seikosha, Tokyo, Japan

[21] Appl. No.: 697,593

[22] Filed: Jun. 18, 1976

[30] Foreign Application Priority Data

Jun. 18, 1975 [JP] Japan ..... 50-73945

[51] Int. Cl.[2] ..... G04C 3/00

[52] U.S. Cl. ..... 58/23 R

[58] Field of Search ..... 58/23 R, 24 R, 85.5, 58/152 R

[56] References Cited

U.S. PATENT DOCUMENTS

| | | | |
|---|---|---|---|
| 3,895,486 | 7/1975 | Hammer | 58/23 R |
| 3,914,931 | 10/1975 | Tsuruishi | 58/23 R |
| 3,998,044 | 12/1976 | Yamauchi | 58/23 R |
| 4,015,208 | 3/1977 | Hammer | 58/23 R |
| 4,015,419 | 4/1977 | Morokawa | 58/23 R |

*Primary Examiner*—James R. Scott
*Assistant Examiner*—Vit W. Miska
*Attorney, Agent, or Firm*—Blum, Moscovitz, Friedman & Kaplan

[57] ABSTRACT

An electronic timepiece having circuitry for automatically adjusting the time rate by comparing same to a randomly selected reference, is provided. A timing rate circuit includes an oscillator for producing a high frequency time standard signal and a divider for producing a low frequency timekeeping signal. The divider includes a plurality of series-connected divider stages, each divider stage being adapted to produce an intermediate frequency signal. A counter is provided for receiving the low frequency timekeeping signal and producing an elapsed time signal representative of time counted thereby. The instant invention is particularly characterized by an error counter coupled to one of the divider stages for receiving an intermediate frequency signal produced thereby for a randomly selected reference period. A reference counter is coupled to the counter in order to receive one of the elapsed time signals produced thereby for the randomly selected reference period and in response thereto is adapted to produce a reference count signal. A processing circuit is adapted to compare the error signal and reference count signal and in response thereto is adapted to apply a frequency adjusting signal to the timing rate circuit to regulate the timing rate of the low frequency timekeeping signal produced by the divider.

9 Claims, 7 Drawing Figures

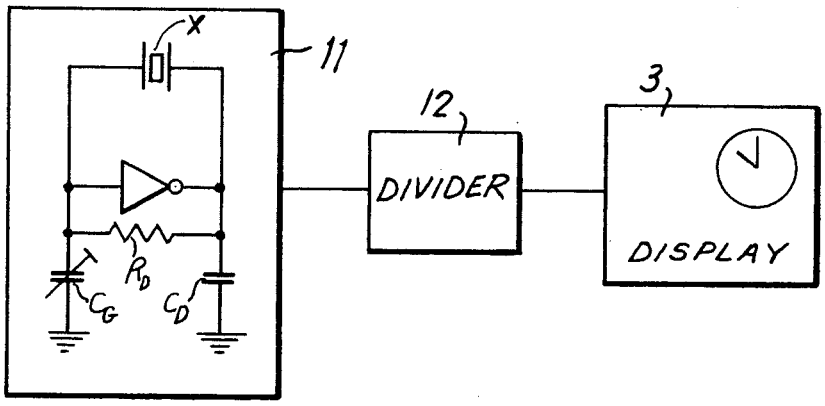
FIG. 1
PRIOR ART
FIG. 2
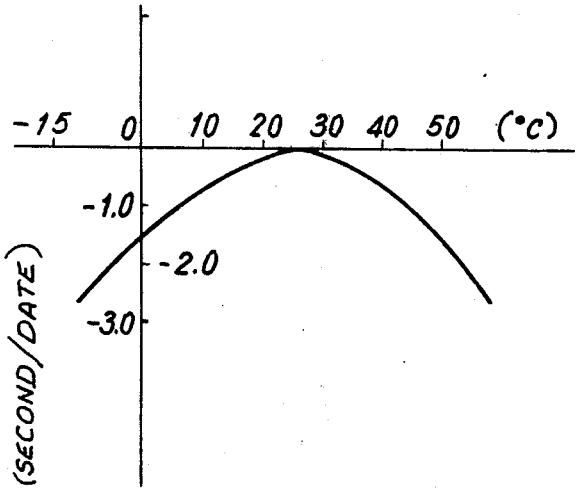

ELECTRONIC TIMEPIECE

BACKGROUND OF THE INVENTION

This invention is directed to an electronic timepiece having frequency rate adjustment circuitry, and in particular, to an electronic timepiece having timing rate adjustment circuitry for comparing the timing rate to a randomly selected reference period in order to automatically regulate the timing rate thereof.

In general, electronic timepieces are formed of three components, two of which are primarily responsible for the accuracy thereof. A first component is an oscillator circuit having a high frequency vibrator as a time standard for producing a high frequency signal, which signal is applied to a divider circuit. The divider circuit is a second component and divides down the high frequency signal to produce a low frequency timekeeping signal, which timekeeping signal is applied to the third component, which component is a conventional analog or digital display. As noted above, the accuracy of the time displayed is dependent upon the accuracy of the high frequency signal produced by the oscillator circuit and the ability to vary the division ratio of the divider circuit and hence adjust the timing rate of the low frequency timekeeping signal produced thereby.

In the art, three approaches have been utilized to adjust the timing rate of the electronic timepiece circuitry. A first approach is to vary the impedances in the oscillator circuit, and in particular, to vary a tuning capacitor, in order to vary the high frequency signal produced by the oscillator circuit, often referred to as the primary frequency. A second approach is to adjust the division ratio of the divider circuit and thereby change the timing rate of the low frequency timekeeping signal produced thereby without effecting any change in the operation of the oscillator circuit. A third approach combines both the first and second approaches by varying both the primary frequency produced by the oscillator circuit and by varying the division ratio of the divider.

Although each of the approaches noted above is effective in improving the accuracy of the low frequency timekeeping signal, changes in the environment, such as temperature changes, aging of the quartz crystal vibrator utilized as time standards for the oscillator circuits, and changes in the effective supply voltage, result in additional variations in the primary frequency which are unaccounted for during manufacture and sale of the electronic timepiece. Accordingly, electronic timepiece circuitry for adjusting the timing rate during operation to take into account changes in the primary frequency is desired.

SUMMARY OF THE INVENTION

Generally speaking, in accordance with the invention, an electronic timepiece wherein the timing rate is compared to a randomly selected reference period in order to automatically adjust the accuracy thereof is provided. A timing rate circuit includes an oscillator for producing a high frequency time standard signal and a divider for producing a low frequency timekeeping signal. The divider includes a plurality of series-connected divider stages, each divider stage being adapted to produce an intermediate frequency signal. A counter is adapted to receive the low frequency timekeeping signal and in response thereto produce elapsed time signals representative of the time counted thereby. An error counter is adapted to receive an intermediate frequency signal produced by a divider stage over a randomly selected reference period. A reference counter is coupled to the counter for receiving one of the elapsed time signals produced thereby for the randomly selected reference period and in response thereto is adapted to produce a reference count signal. A processing circuit is adapted to compare the error signal and reference count signal and in response thereto apply a frequency adjusting signal to the timing rate circuit to thereby regulate the timing rate of the low frequency timekeeping signal produced thereby.

Accordingly, it is an object of this invention to provide electronic timepiece circuitry for automatically adjusting the timing rate in response to changes in the primary frequency.

It is a further object of this invention to provide an improved electronic timepiece wherein the timing rate is automatically adjusted by comparing same to a randomly selected reference period.

Still a further object of the instant invention is to provide an electronic timepiece including circuitry for calculating errors in the timing rate over randomly selected reference periods and thereby utilizing the calculated error to adjust the timing rate of the electronic timepiece.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a block circuit diagram of an electronic timepiece constructed in accordance with the prior art;

FIG. 2 is a graphical comparison of temperature-frequency characteristics of the quartz crystal vibrator depicted in FIG. 1;

DETAILED DESCRIPTION OF THE PREFERRED EMBODIMENTS

Reference is now made to FIG. 1, wheren an electronic timepiece including an oscillator circuit, generally indicated as 11, a divider circuit, generally indicated as 12, and a display, generally indicated as 3, are depicted. The oscillator circuit 11 includes a quartz crystal vibrator X, an inverter circuit 1, feedback resistor $R_D$, fixed capacitor $C_D$ and tuning capacitor $C_G$. The oscillator circuit is adapted to produce a high frequency time standard signal, referred to as a primary high frequency signal $f_b$. Divider circuit 12 is formed of a plurality of series-connected divider stages and is adapted to receive the primary high frequency $f_b$ and in response thereto produce a low frequency timekeeping signal $f_0$. The low frequency timekeeping signal $f_0$ is applied to a display 3, which display is illustrated in FIG. 1, by way of example, as an analog display. Nevertheless, liquid crystal and light emitting diode displays are also commonly utilized.

Figure 3:
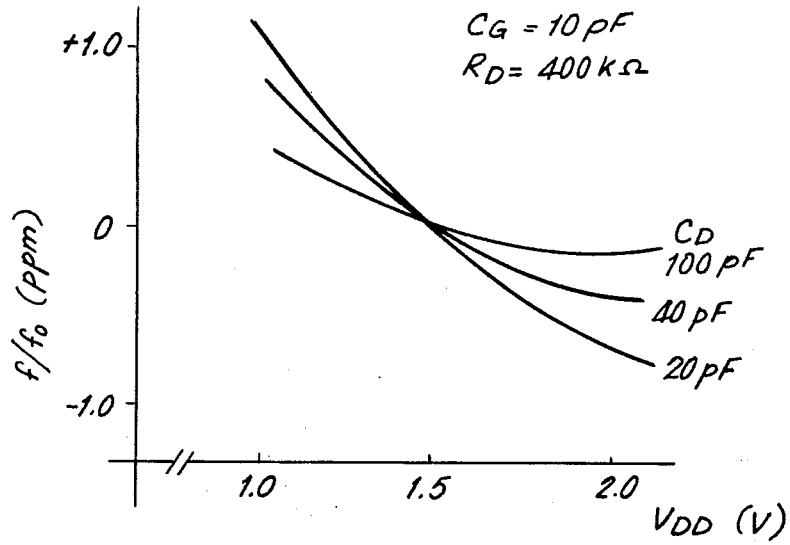
FIG. 3 is a graphical comparison of the supply voltage-frequency characteristics of the quartz crystal oscillator circuit depicted in FIG. 1.

It is noted that the accuracy of the timepiece is dependent upon the stability of the primary high frequency signal. Nevertheless, environmental factors such as changes in temperature, aging, shock and changes in the supply voltage result in a variation in the timing rate of the primary high frequency signal. Changes in the frequency, as a result of temperature changes and as a result of variations in the supply voltage are illustrated in FIGS. 2 and 3, respectively.

Accordingly, the usual practice is to design the quartz crystal oscillator circuit to provide stable operation under environmental conditions most likely to be encountered. Nevertheless, this results in a loss in accuracy when the timepiece is utilized over long periods of time in less than favorable surroundings. Thus, the instant invention is particularly characterized by providing circuitry for automatically adjusting the accuracy of the timing rate in response to changes thereof, to thereby avoid a loss of accuracy due to less than completely satisfactory surroundings, aging or environmental conditions.

It is noted that conventional electronic timepieces utilizing a quartz crystal vibrator oscillating at frequencies on the order of 32 KHz are capable of guaranteeing accuracy to 15 seconds a month. The instant invention is directed to utilizing the accuracy of the electronic timepiece as a basis for providing self-adjusting error correction. For example, if an electronic timepiece has a ten second per month accuracy, if the timing rate is corrected by one second every 3 days, i.e, 10 seconds per month, it is possible to obtain a monthly accuracy not exceeding one second per month during actual use. In order to adjust the period in accordance with the above noted method, the period measured to obtain the error of the timing rate must be no greater than the smallest digit of time displayed by the timepiece. If the normalized error value, that is, the amount of cumulative error caused by a variation in the timing rate over a predetermined period is calculated, it is possible to adjust the timing rate of the electronic timepiece by either tuning the oscillator circuit or varying the division ratio of the divider circuit.

As detailed below, the instant invention provides circuitry for measuring the normalized error and for feeding the error back to the circuitry to automatically adjust the timing rate thereof. Specifically, two distinct timing rate signals are measured over a randomly selected reference period, which period is measured against an external time source. Moreover, in electronic timepieces, the digits of time above minutes are almost always correct since it is unlikely that errors could be accumulated in excess of 3 minutes, with the exception of when a digital timepiece is one second from displaying 12.59 o'clock P.M. Since even the minutes digit is normally correct, it is only necessary to calculate the seconds error. Thus, as illustrated below, the elasped time signals produced by error counter and having a distinct period can be utilized as the standard time for determining the normalized error. Accordingly, the instant invention measures two distinct time rate signals of the timepiece for a randomly selected reference period, which period is measured against an external time source, in order to obtain a normalized error signal and feed same back to the time rate circuitry to effect adjustment thereof.

Figure 4:
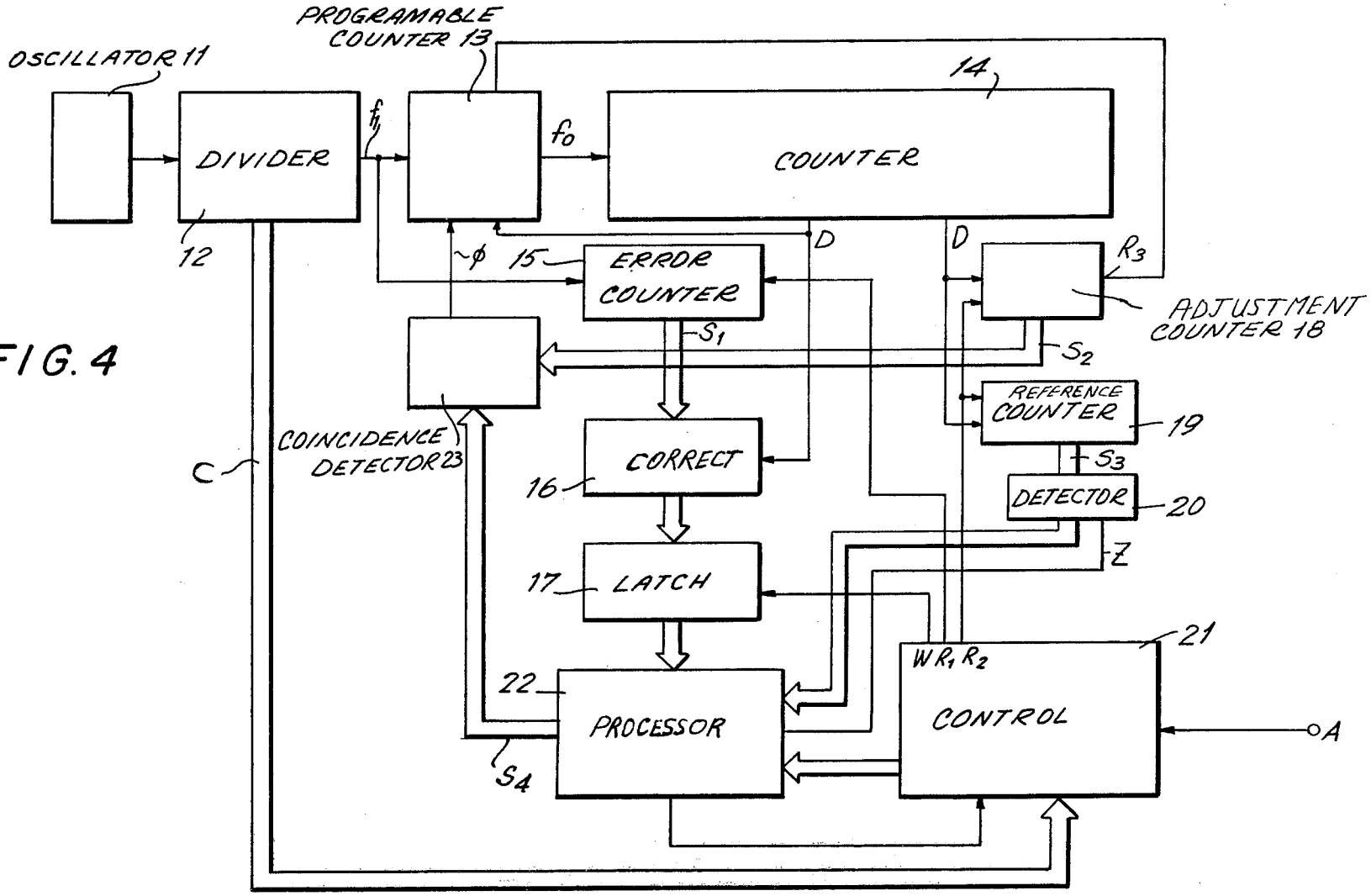
FIG. 4 is a block circuit diagram of an electronic timepiece rate adjustment circuit constructed in accordance with a first embodiment of the instant invention.

Reference is now made to FIG. 4, wherein a block circuit diagram of an electronic timepiece having a timing rate adjustment circuit constructed in accordance with the instant invention is depicted, like reference numerals being utilized to denote like elements depicted and described above. The divider circuit 12 produces an intermediate frequency signal to a programable counter 13, which counter is programable to vary the division ratio from 1/2 to 1/3 to 1/2 to 1/1. As will be explained in greater detail below, the programable counter 13 normally provides a division ratio of 1/2 during operation of the electronic timepiece depicted in FIG. 4. The low frequency timekeeping signal $f_0$ produced by the programmable counter 13 is applied to a counter circuit 14, which circuit is comprised of a plurality of series-connected counters adapted to produce elapsed time signals representative of seconds (not shown), minutes (not shown), hours (not shown), days D and if desired, the date (not shown). The elapsed time signals are applied to a digital display in order to drive the respective display digits (not shown) and thereby display actual time.

The intermediate frequency signal $f_1$ produced by the divider 12 is applied to an error counter 15, which counter is adapted to measure the error in the timing rate and apply same to the correcting circuit 16 as an output $S_1$. The correcting circuit 16 receives the count of the error counter 15 at a time determined later by the day signal D applied thereto, in order to normalize the error determined by the error counter 15 with respect to the timing rate being advanced and/or retarded. The corrected error signal counted by the correcting circuit 16 is applied to a latch circuit 17. A first adjustment counter 18 is coupled to the counter 14 and is adapted to receive the day elapsed time signal D produced thereby, and apply the count thereof $S_2$ to a coincidence detector 23. A reference counter 19 is also adapted to receive the day elapsed time signal D from the counter 14 and apply the count thereof $S_3$ through a detector circuit 20 to a processor circuit 22. The detector 20 is adapted to detect when the reference counter 19 is in a zero state and in response thereto apply an inhibit signal Z to the processor circuit to inhibit same from applying an output signal $S_4$ to the coincidence detector 23. The processor circuit 22 is provided with an inhibit gate which prevents same from functioning when the inhibit signal Z is applied to it. A control circuit 21 is adapted to receive an input reference signal A and in response thereto control the operation of the processor 22 and the sequence in which reset signals $R_1$ and $R_2$ are applied to the error counter 15 and the adjustment counter 18 and reference counter 19, respectively, and additionally when a write signal W is applied to the latch circuit 17. The operation of the control circuit 21 is synchronized to the operation of the electronic timepiece by synchronizing signal (clock) C produced by the divider circuit 12. Additionally, the processor 22 feeds back a signal to the control 21 in order to synchronize the operation therebetween. As will be explained in greater detail below, the processor circuit 22 is adapted to divide the error signal by the reference count signal in order to provide a rate adjusting signal $S_4$. The rate adjusting signal $S_4$ is applied to the coincidence detector 23 and when coincidence between same and the output $S_2$ from the adjustment counter 18 is detected, a change in the division ratio of the programable counter 13 from either 1/2 to 1/3, when timing rate is advanced, or alternatively, from 1/2 to 1/1 when the timing rate is retarded, is effected. Briefly stated, the operation of the timing rate circuitry depicted in FIG. 4 is to determine the error signal and thereafter to adjust the programable counter 13 from the normal division ratio of 1/2 to either 1/1 or 1/3 to thereby add or subtract a second pulse to the low frequency timekeeping signal $f_0$ whenever the error in the unit of time occurs so as to increase the accuracy of the timepiece.

It is noted that the inhibit signal Z is applied to the processor, in order to prevent a change in the division ratio of the programable counter 13 when the battery is changed in order to prevent incorrect adjustment of the frequency rate. Moreover, inhibit signal Z prevents any inadvertant correction from occurring as long as the reference counter 19 is maintained in its initial state of zero.

As is detailed below with respect to the operation of the electronic timepiece depicted in FIG. 4, error adjustment is made by utilizing an external time standard to define the periods for comparison. Accordingly, an external signal is applied at input terminal A by utilizing conventional switch means, or the like, in order to apply an input signal A in response to an accurate reference signal such as those given by a telephone, radio or television. In other words, upon hearing the tone representable of a time including 00 seconds, the user would depress a switch to apply signal A, or the timepiece could automatically respond to the tone selectively applied thereto. Accordingly, the operation of the circuit depicted in FIG. 4 is explained by identifying three distinct stages. The first stage occurs when each of the circuit elements of the electronic timepiece are energized. The second stage occurs when the normalized error signal is counted for the randomly selected reference period, determined by the application of the input signal A. The third stage is based on the adjustment effected by the time rate adjustment circuitry after the error is determined during the second stage, which adjustment is continuously effected until a new error is produced by a subsequent error signal produced during a subsequent reference period and in response to a further correcting signal A being applied to control 21. As is detailed with greater specificity below, the second stage and third stage operations are simultaneously conducted thereby requiring two separate groups of counter circuits for producing an error signal and a reference count signal in order to permit the process to compute a rate changing signal to be applied to the timing rate circuitry.

Accordingly, a first mode of operation of the circuit depicted in FIG. 4 is detailed with respect to the three stages noted above. In the first stage, for example, when a new battery is inserted into the electronic timepiece, the adjustment counter 18, reference counter 19 and error counter 15 are reset to an initial state of zero. Accordingly, the detector circuit 20 detects the initial state of the reference counter 19 and applies inhibit signal Z to the processor 22 in order to prevent the output signal $S_4$ from being produced by the processor, thereby maintaining the division ratio of the programable counter 13 at 1/2. Accordingly, during the first stage, the timepiece circuitry operates in a normal timekeeping mode. At power on, the seconds counter is reset to zero in conjunction with the setting of the timepiece.

At power on of the first stage, the error counter 15, adjustment counter 18 and reference counter 19 are initially zeroed by outputs $R_1$ and $R_2$, and begin counting thereafter the D signals provided from counter 14. Accordingly, in the second stage, when the input signal A is applied to the terminal A the next time, the output $S_1$ of the error counter 15, which output has been corrected by the correcting circuit 16 is read into the latch circuit 17 and stored, and the error counter 15 is reset to zero by output $R_1$. Additionally, since it would be possible for the state of the counter circuit 19 to be changed during application of signal A, once termination of the carry operation is effected in the counter 14, the processing circuit is brought into operation. Since reference counter 19 has been counting, inhibit signal Z does not prevent operation of the processor 22. The processor compares the error signals in the latch circuit 17 with the count of the reference counter 19 (corrected $S_1$ and $S_3$) signal A and stores in the register thereof a rate adjustment value equal to the amount of rate adjustment necessary to adjust the timing rate of the electronic timepiece. In other words, the division circuit in processor circuit 22 divides the count represented by signal $S_3$ by the count in latch circuit 17 to determine $S_4$, a count (preferably digital or otherwise coded) representing the frequency of correction required. Additionally, to complete the second stage, once the rate adjustment information is read into the register of the processor 22, the reference counter 19 and adjustment counter 19 are reset by the output $R_2$ to begin determining the error signal to be ultimately determined when the next or third reference input signal A is applied to the control 21.

The third stage of the invention, namely, effecting continuous adjustment of the timing rate is effected each time that the coincidence detector 23 detects coincidence between the output $S_2$ of the adjustment counter 18 and the output $S_4$ of the processor 22. Accordingly, if the error determined by the processor 22 determines that the division ratio must be delayed by one pulse every two days, the coincidence detector 23 detects coincidence between the output $S_4$ and the output $S_2$ of the adjustment counter 18 once every two days and thereby applies adjustment signal $\phi$ at a particular time selected by the day elapsed time signal to thereby change the division ratio of the programable counter 13 to 1/1 in order to add a pulse to the signal $f_0$ and hence increase the count by one second every two days. Similarly, if the error signal is an advance signal every two days, the division ratio of the programable counter 13 would be changed to 1/3 once every two days.

Accordingly, the instant invention is characterized by measuring the amount of error over a randomly selected reference time by setting the error counter, and reference counter 19 to be at a zero state when the reference signal is at an instant when the seconds count is actually 00, and to thereafter compare the signal produced by the error counter with the signal produced by the reference counter, after a reference period, to thereby obtain the amount of rate adjustment necessary. For this purpose, the processer includes a divider circuit capable of dividing the error count into the reference count to thereby obtain a sufficient ratio of adjustment in order to determine the frequency with which the division ratio of the programable counter should be varied. In a further specific example, if the timepiece were to commence operation after having the battery changed, at time 10.00.00 A.M. (10 hours, 0 minutes, 0 seconds) which time represents the time of the external reference. At that moment, the reset signal $R_1$ resets to zero the error counter 15 and additionally, the adjustment counter 18 and reference counter 19 are reset to zero. Counters 18 and 19 would begin counting at 12.00 midnight. At that time, the day elapsed time signal D is produced by the counter 14 and applied to the correcting circuit 16, to thereby permit same to begin counting signal $S_1$. Additionally, the day elapsed time signal D is also applied to the adjustment counter 18 and reference counter 19, which counters are indexed by one in response thereto. The processor circuit 22 at this time begins to receive a count from reference counter 19, but cannot effect a processing of the error signal since the latch circuit 17 does not as yet have information stored therein. Thirty days after, at 11.35 P.M., which time period is arbitrarily selected by the operator of the timepiece, a reference signal A is applied to the control circuit 21. The correcting circuit 16, which circuit only counted seconds, should read zero if the timepiece were perfectly accurate. In fact it reads a number different from zero representative of the cumulative number of seconds error during the period counted by reference counter 19. If the number is between 0 and 29, the timepiece is assumed to be advanced by that number of seconds. If the number is 30 to 59 the timepiece is assumed to be retarded by the difference between the number and 60. The processor circuit 22 makes this determination, the result being reflected in signal $S_4$ so that signal $\phi$ can select the 1/1 or 1/3 mode of counter 13. Accordingly, in response to the input of signal A, the error signal is written into the latch 17 and is compared with the count of the reference counter 19, which count after thirty days is thirty. Assuming that the error signal written into the latch 17 is fifty, the processor circuit divides the count 30 of the reference counter by the error count minus ten and determines that correction over thirty days is required once every three days. Accordingly, the processor circuit produces the signal $S_4$, a code representable of a count of three which is stored in a register in the processor circuit and applied to coincidence circuit 23, which signal will coincide with the count of the adjustment counter 18 after three days and thereby apply the signal $\phi$ to the programable counter 13 to thereby change the division ratio to 1/1 once every three days. Adjustment counter 18 is reset by signal $R_3$ every time signal $\phi$ is applied to programable counter 13, which time is synchronized by signal D. Accordingly, the accuracy is measured by the error counter and the reference counter and is periodically fed back by the adjustment counter and processor to thereby effect continuous adjustment of the timing rate of the electronic timepiece.

At the next application of Signal A at any arbitrary time (so long as the seconds count is 00), error counter 15 is again reset to zero so that the counting starts again, new corrected signals $S_1$ from $S_3$ from latch circuit 17 and reference counter 19 are processed and a new signal $S_4$ representative of a new error rate is applied to coincidence detector 23 so that thereafter, correction is effected in response to newly collected cumulative error data, reflecting the effects of aging, temperature and the like in the crystal. In the embodiment depicted, counters 18 and 19 are selected as day counters but references such as hour or minute counters could be used. In the embodiment depicted, only seconds are accumulated in counter 15 and latch 17 but further digits (minutes, etc) may be accumulated, in which case, if minutes are also accumulated in counter 19, processor 22 may first subtract the error count from the reference count to determine the error and whether the error is one of retard or advance, before performing the division step. Means can be provided to insure accumulation of error no more than 29 seconds in circuits 15 and 16 to insure identification of retard and advance states. This can be done by automatically recycling to zero counters 15 and 19 after a predetermined count of counter 19.

It is noted that the processor circuit requires a circuit capable of dividing the error count by the reference count and that the type of calculator circuits utilized in tabletop and pocket sized calculators is particularly suitable for use in small sized electronic timepieces where space is limited and only a limited capacity calculator circuit is needed. It is noted however that with respect to the adjustment counter 18 and reference counter 19, which counters are utilized to store counts over extended periods of time, a time sharing type counter circuit can be employed. Accordingly, the benefit of the instant invention is that timing rate adjustment is effected the moment that the electric power is applied to the electronic timepiece by memorizing the normalized time error in a register.

Figure 6B:
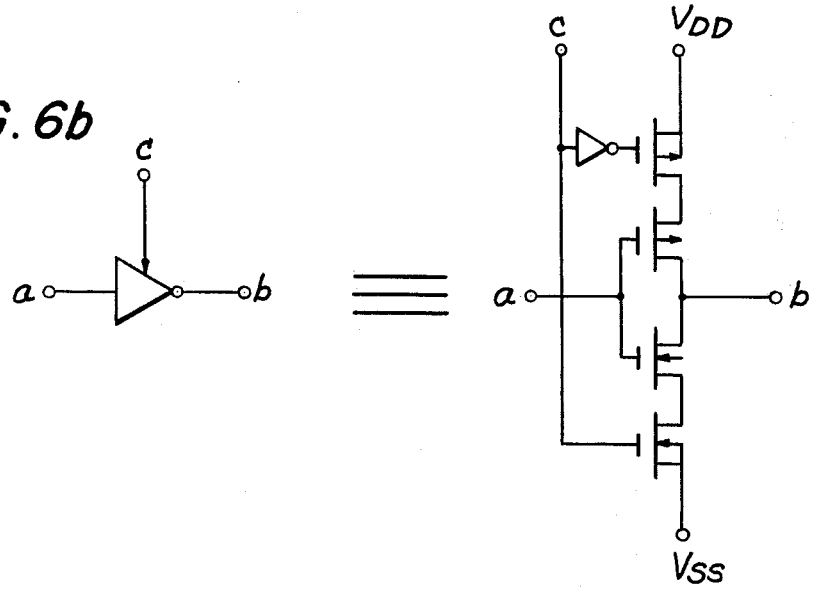
FIG. 6*b* is an illustration of a triple-valve C-MOS logic inverter particularly suited for use in the circuit depicted in FIG. 6*a*.
Figure 6A:
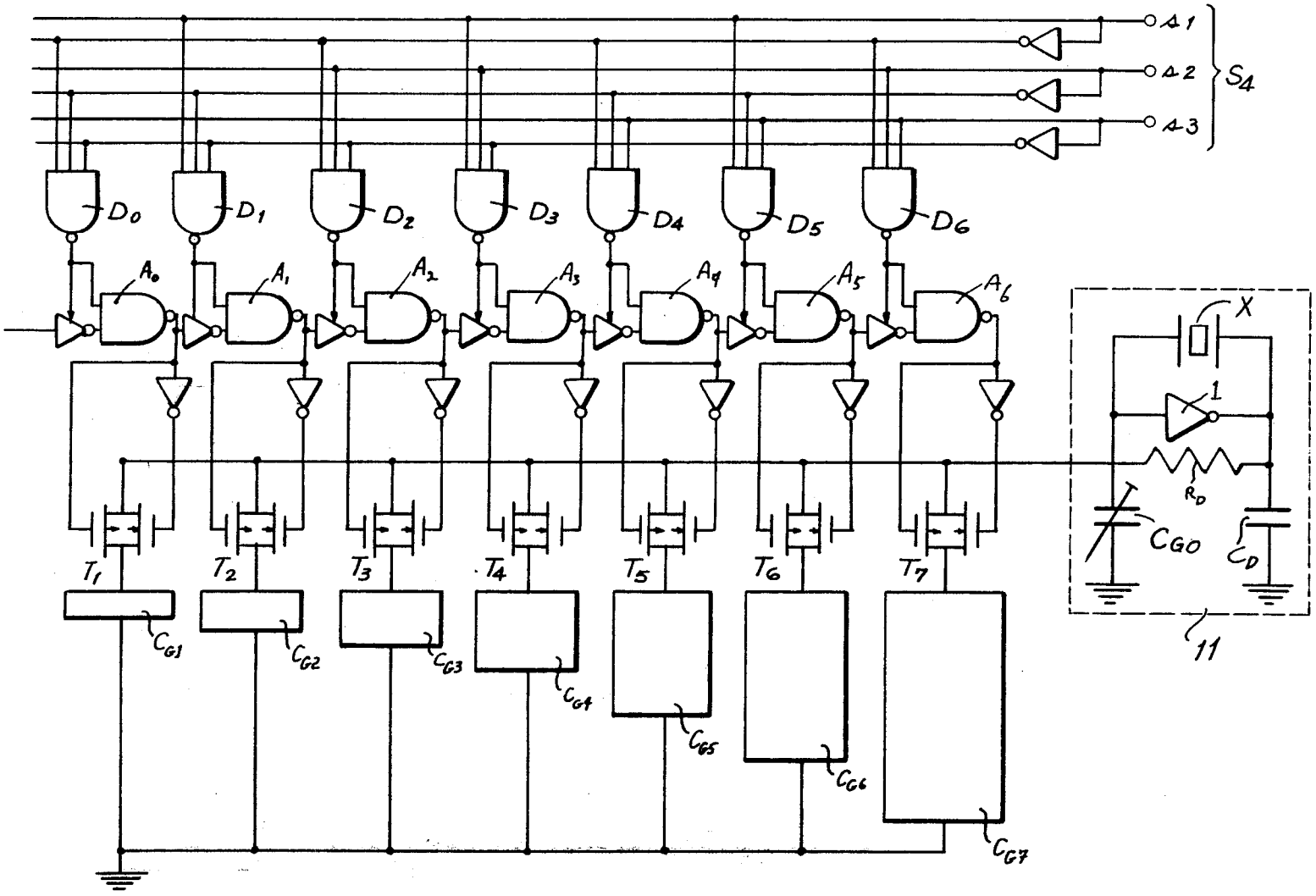
FIG. 6*a* is a detailed circuit diagram of a timing rate adjustment circuit constructed in accordance with a second embodiment of the instant invention.

Reference is now made to FIG. **6*a* wherein a timing rate adjustment circuit constructed in accordance with a further embodiment of the instant invention is depicted. It is noted that the embodiment depicted in FIG. 6*a* is particularly characterized by a variation of the primary frequency in order to improve the accuracy of the low frequency timekeeping signal. To this end, the embodiment of FIG. 6*a* adopts the error circuitry illustrated in FIG. 4, including the processor circuit for producing a binary coded timing rate adjustment signal $S_4$, with the adjustment counter 18 and coincidence detector 23** eliminated.

Figure 5:
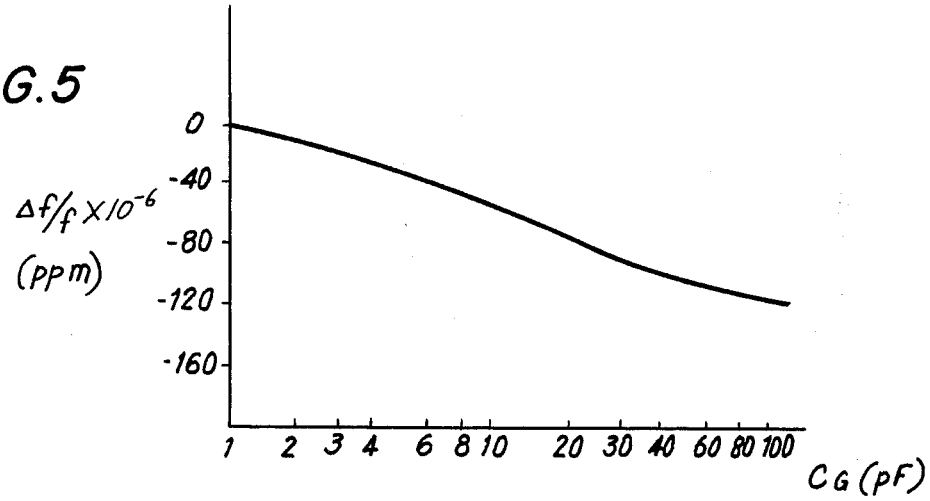
FIG. 5 is a graphical comparison of the gate capacitor-frequency characteristic of the quartz crystal oscillator circuit depicted in FIG. 1.

It is noted that the primary frequency produced by a quartz crystal oscillator circuit is controlled by varuing the magnitude of the tuning capacitor $C_G$, which capacitor is coupled between the common gate terminal of a C-MOS inverter and ground. A graphical illustration of the change in the primary frequency in response to a variation in the tuning capacitance $C_G$ is illustrated in FIG. 5. The circuit in FIG. **6*a* is designed to determine an error in the same manner as the circuit depicted in FIG. 4, and thereafter, utilize the error to adjust the frequency rate of the primary high frequency produced by the oscillator circuit 11**.

Referring specifically to FIG. **6*a*, the rate adjustment signal $S_4$ is a binary coded signal having values $s_1$, $s_2$ and $s_3$, which values are applied to decoder NAND gates $D_0$ through $D_6$. The outputs of each of the decoder NAND gates $D_0$ through $D_6$ are coupled as a first input to NAND gates $A_0$ through $A_6$, and additionally to a three-value logic inverter $I_0$ through $I_6$. The three-value logic inverter is comprised of C-MOS logic elements and is particularly illustrated in FIG. 6*b***.

If the rate adjustment signal $S_4$ is adapted to select the output level of $D_3$, the coded inputs $s_1$, $s_2$ and $s_3$ will have H, H, L values respectively. Accordingly, the output level of the decoder NAND gate $D_3$ is a low L level signal, and the outputs of the remaining decoders $D_0$ through $D_2$ and $D_4$ through $D_6$ are high H level signals. Accordingly, the gate circuits coupled to the outputs of decoders $D_0$ through $D_2$ and $D_4$ through $D_6$ turn on the transmission gates $T_1$ through $T_3$ and turn OFF transmission gates $T_4$ through $T_7$. Accordingly, the gate capacitance of the oscillator circuit 11 is equal to the value of each of the parallel capacitance values of the open gates $T_1$ through $T_4$ and thus, $C_G = C_{G0} + C_{G1} + C_{G2} + C_{G3}$. Moreover, such an embodiment is particularly suitable for use in analog divider circuits such as a monostable multivibrator.

Accordingly, by utilizing the processor circuit to obtain a timing rate error signal, the timing rate error signal can be fed back through the decoder circuit to thereby select a proper combination of capacitances disposed in parallel and thereby vary the magnitude of the gate capacitance of the oscillator and hence effect a tuning of the primary high frequency produced thereby.

It is noted that both the embodiment depicted in FIG. 4 and the embodiment depicted in FIG. 6*a* utilizes the reference counter 19 and it is necessary for the reference counter 19 to have a sufficiently high capacity in order to permit timing rate adjustment over long and irregular periods of time. However, if the period for measuring the error in the timing rate is limited to a fixed period, the capacity of the counter circuit 19 and processing circuit 22 can be considerably limited and correction in accordance with the invention still obtained.

In still a further variation of the instant invention, timing rate adjustment can also be obtained by detecting only the advance or retard of the timing rate without computing the normalized timing error in the same manner that it is computed in FIG. 4. Instead, an up-down counter can be utilized in place of the register in the processing circuit 22 for storing the processed result, so that the state of the up-down counter is advanced or reduced against the advance rate or retard rate of the electronic timepiece. Moreover, when rate adjustment is not performed over a fixed period, the use of a circuit to inhibit a change in the state of the up-down counter thereby permits the timing error to be accumulated and maintained within a fixed range.

As aforenoted, the instant invention is particularly characterized by providing for adjustment of the timing rate in order to take into account changes in environment. Moreover, minimum power consumption and high accuracy are obtained without the necessity of utilizing a timing rate circuit including a vibrator and divider in the MHZ range. It is further noted that the circuit element can be monolithically incorporated into a circuit chip utilizing C-MOS-FET, IIL, and any other suitable integrating circuit technique as if the timing rate were adjusted by a conventional timer capacitor.

It is further noted that the instant invention is particularly suitable for only for use in electronic wristwatches but additionally in electronic clocks wherein the accumulated error is easy to compute due to the low frequencies at which such clocks operate. An additional feature of the instant invention is that the processor can be provided with a non-destructive memory for memorizing $S_4$ so that a preset correction is effected upon power turn ON to permit an even further reduction in the accumulated error over a year.

It will thus be seen that the objects set forth above, among those made apparent from the preceding decription, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electric timepiece having timing rate circuit means including oscillator means for producing a high frequency time standard signal and divider means for producing a low frequency timekeeping signal, said divider means including a plurality of series-connected divider stages, each said divider stage being adapted to produce an intermediate frequency signal, and counter means for receiving said low frequency timekeeping signal and in response thereto being adapted to produce elapsed time signals representative of the time counted thereby, the improvement comprising error counting means coupled to one of said divider stages for receiving an intermediate frequency signal produced thereby over a randomly selected reference period, a reference counter coupled to said counter means for receiving one of said elapsed time signals produced thereby for said randomly selected reference period and in response thereto being adapted to produce a reference count signal, adjustment counter means adapted to receive one of said elapsed time signals produced by said counter means and in response thereto produce an adjustment count signal and processing means for comparing said error signal and said reference count signal and in response thereto, said processing circuit being adapted to produce a rate adjustment signal, said processing means further including coincidence means for detecting coincidence between said adjustment count signal and said rate adjustment signal and in response to said coincidence therebetween apply a frequency adjusting signal to said timing rate circuit means to regulate the timing rate of said low frequency timekeeping signal produced thereby.

2. An electronic timepiece as claimed in claim 1, wherein said divider means includes division ratio adjustment means coupled to said last series-connected divider stage for producing said low frequency timekeeping signal, said division ratio means being adapted to vary the frequency rate of said low frequency timekeeping signal in response to said frequency adjusting signal being applied thereto.

3. An electronic timepiece as claimed in claim 2, wherein said division ratio means is adapted to selectively vary the timing rate of said low frequency timekeeping signal by one-half the period of said intermediate frequency signal produced by said last series-connected divider stage in response to said frequency adjustment signal being applied thereto.

4. An electronic timepiece as claimed in claim 2, and including control means adapted to receive randomly selected inputs for determining a reference period, said control means being adapted to reset said error counting means, adjustment counter means and reference counter means to zero in response to each input received thereby, said processing circuit being adapted to store the reference count signal accumulated between each input to the control in order to compare same to the error signal produced by the error counter means between each input to the control means.

5. An electronic timepiece as claimed in claim 4, wherein said error signal is representative of the variation in time counted between inputs to said control means and the actual time elapsed between inputs, and the reference count signal is representative of the time counted by said counter means during the period between inputs to the control means, said processor means being adapted to divide said error signals by said reference count signal to thereby determine the frequency that said frequency adjusting signal should be applied to said division ratio means.

6. An electronic timepiece as claimed in claim 5, wherein said adjustment counter means is coupled to said division ratio means and is reset in response to each variation in the division ratio detected thereby, said adjustment signal produced by said counter means being representative of elapsed time counted by said counter, said coincidence means being adapted to detect coincidence in the divided signal produced by said processor means and the adjustment signal produced by said counter, and in response thereto periodically adjust the division ratio means to thereby vary the timing rate of the low frequency timekeeping signal.

7. An electronic timepiece as claimed in claim 1, wherein said oscillator means includes a tuning capacitor means for varying the high frequency time standard signal in response to changing the value of capacitor thereof, said tuning capacitor means being coupled to said processor means to receive rate adjusting signal produced thereby and in response thereto select a capacitance value to thereby adjust the time rate of the high frequency time standard signal.

8. An electric timepiece as claimed in claim 7, wherein said tuning capacitor means includes a first tuning capacitor for adjusting the value of capacitance of said oscillator means, and second capacitor means coupled in parallel with said first capacitor, said second capacitor means including a plurality of parallel selectively coupled capacitance means, the number of said selectively coupled capacitance means coupled in parallel with said first tuning capacitor determining the capacitance value of said oscillator means.

9. An electronic timepiece as claimed in claim 8 and including a plurality of decoder means coupled intermediate said processor means and said second capacitor means, each said decoder means being coupled in series with one of said parallel coupled capacitance means for selectively coupling certain of said second capacitance means in parallel with said timing capacitor in response to said frequency adjusting signal produced by said processor means to thereby regulate the timing rate of said high frequency time standard signal and hence said low frequency timekeeping signal.

* * * * *